US006193229B1

(12) United States Patent
Hall et al.

(10) Patent No.: US 6,193,229 B1
(45) Date of Patent: Feb. 27, 2001

(54) SIGNATURE FEEDER AND METHOD INCLUDING A VARIABLE SPEED SEPARATOR DISK

(76) Inventors: David F. Hall, 18 Washington Pl., Plattsburgh, NY (US) 12901; Jonh E. Prim, PO Box 202, West Chazy, NY (US) 12992

( * ) Notice: Subject to any disclaimer, the term of this patent is extended or adjusted under 35 U.S.C. 154(b) by 0 days.

(21) Appl. No.: 09/286,978

(22) Filed: Apr. 6, 1999

(51) Int. Cl.[7] ..... B65H 3/06

(52) U.S. Cl. ..... 271/109; 271/3.05; 271/4.01; 271/4.08; 271/10.01; 271/42

(58) Field of Search ..... 271/1, 3.04, 3.05, 271/3.08, 3.17, 4.01, 4.08, 4.09, 4.1, 10.01, 10.09, 18, 109, 112, 114, 11, 10.11, 100, 105, 99, 115; 414/17, 20

(56) References Cited

U.S. PATENT DOCUMENTS

| | | | | |
|---|---|---|---|---|
| 4,549,730 | * | 10/1985 | Weller et al. | 271/11 |
| 5,499,803 | | 3/1996 | Farr . | |
| 5,531,433 | | 7/1996 | Hawkes et al. . | |
| 5,833,229 | * | 11/1998 | Prim | 271/11 |

* cited by examiner

*Primary Examiner*—Donald P. Walsh
*Assistant Examiner*—Mark J. Beauchaine
(74) *Attorney, Agent, or Firm*—Kevin H. Fortin, Esq.

(57) ABSTRACT

A signature feeder for delivering stacked signatures to a conveyer or gatherer includes a variable speed separator disk for separating signatures from the stacked signatures. The separator disk mechanically couples with a servomotor. The separator disk has a blade with a leading edge and a trailing edge. The servomotor accelerates the separator disk through the stacked signatures to separate signatures from the stacked signatures. After a signature separates from the stacked signatures, the servomotor slows the separator disk.

20 Claims, 4 Drawing Sheets

SIGNATURE FEEDER AND METHOD INCLUDING A VARIABLE SPEED SEPARATOR DISK

BACKGROUND OF THE INVENTION

1. Field of the Invention

The present invention relates to sheet material handling systems, and more particularly to devices for separating signatures.

2. Background Art

The binding and printing industries often rely on high-speed sheet material handling systems for printing, collating signatures and binding the collated signatures. A typical system includes a stack of signatures, a separator, a sucker arm, a feed drum and a conveyer for collating signatures. The separator separates signatures from a stack of signatures. The sucker arm draws the separated signature towards the feed drum. The feed drum rotates, griping the separated signature and delivering it to the conveyer. The conveyer transports the signature for collation, binding and other operations, for example. Typically, a common drive mechanism drives the separator, sucker arm, feed drum and the conveyer.

Throughput depends on how closely together the signatures are spaced, and on how fast the signatures are moved. Accordingly, throughput may be optimized by spacing signatures as closely together as possible and by maximizing system speed.

Rotational speed of the separator disk is of fundamental importance to handling system performance. The faster the separator disk can rotate from the position where it enters the stack of signatures to a second position where a signature is separated, the better system throughput can be.

In an apparent attempt to overcome limitations to higher throughput rates, a sheet material handling apparatus is disclosed in U.S. Pat. No. 5,531,433 to Hawkes et al. This disclosure is incorporated herein by reference. Hawkes et al. recognize the problem of minimizing velocity mismatch between the conveyer and the feed drum. The proposed solution is to provide a rotatable ring member around a feed drum. The ring member rotates to have a velocity close to that of the conveyer. Hawkes et al. address the velocity mismatch between the conveyer and the feed drum.

Assuming that the Hawkes et al. feed drum delivers signatures faster and more reliably than a standard feed drum, the separator for the Hawkes et al. apparatus must operate fast enough to keep the feed drum properly supplied with signatures. Simply speeding up an existing separator may not be effective because the common drive mechanism may require the feed drum and the sucker bar to operate at a rate proportional to the separator speed. Accordingly, a faster way of delivering signatures to the feed drum is desired.

In typical handling systems having an array of feeders, the common drive mechanism includes a mechanically driven shaft and the array of separators and the feed drums are chain driven by the shaft to rotate at a rate proportional to the rate of shaft rotation. Such shaft driven systems are not always easily adjustable. Fine tuning the operation of the separator, feed drum and sucker arm takes time and effort. As a result, optimizing throughput is not a simple task, particularly when the handling system feeders feed signatures of various sizes.

U.S. Pat. No. 5,499,803 to Farr discloses a shaft driven material handling system having an array of feeders, the disclosure of which is incorporated herein by reference. The Farr system is broken into subsystems having discrete signature feeders. Each sub system operates on a separate drive shaft. Accordingly, each subsystem can be optimized independently to maximize throughput rates. Farr, however, fails to disclose a way of individually optimizing the feeders. Accordingly, what is desired is an improved way of feeding signatures that optimize handling system throughput.

SUMMARY OF THE INVENTION

The present invention includes a feeder for delivering stacked signatures to a conveyer. The feeder has a rotatable feed drum, a rotatable separator disk, a variable speed servomotor and a servo control system.

The separator disk has a blade with a leading edge and a trailing edge. The servomotor mechanically couples with the separator disk to rotate the blade at a variable speed from a first position where the leading edge contacts the stacked signatures, to a second position, where the blade exits the stacked signatures, to a third position. The separator disk separates a signature, forcing the separated signature towards the feed drum. Separation occurs at a point while the separator disk rotates between the first position and the second position.

The feed drum has a periphery with at least one gripper. The feed drum rotates the gripper into a gripping position with respect to the separated signature, grips the separated signature and delivers it to the conveyer.

After the separator disk exits from the stacked signatures, the blade slows to the third position. The blade reaches a minimum velocity in the third position. Slowing the disk provides time for the feed drum to deliver the separated signature to the conveyer.

The servo control system couples with the servomotor to regulate servomotor speed and acceleration. The servo control system is programmable to assure that the separator disk blade moves between the first position and the second position as quickly as practical. The control system can be manually operable at the feeder, may be controlled from a desktop computer, or may be integrated into a network of control systems designed to optimize handling system throughput. It can be appreciated that the servo control system and servomotor can be integrated with new feeder designs, or be retrofit on existing feeders.

According to one aspect of the invention, the feeder includes a command signal generator and a comparator. The command signal generator couples to the feed drum and to the comparator for detecting feed drum position and communicating feed drum position to the comparator. The comparator couples with the servo control system to coordinate the separator disk rotation with the feed drum rotation so that the gripper enters the gripping position when the separator disk separates a signature from the stacked signatures.

The servo control system includes a servo amplifier coupled with the comparator. The comparator detects servomotor position error and communicates a signal reflective of the position error to the servo amplifier. The servo amplifier amplifies the position error signal and communicates the amplified signal to the servomotor to cause the servomotor to automatically rotate the separator disk to eliminate the position error.

According to one aspect of the invention, the feeder is part of a multi-feeder system, each servomotor includes an absolute encoder coupled with the comparator to deliver separator disk position information to the comparator.

According to an alternate aspect of the invention, the servomotor includes an incremental encoder coupled with the comparator to deliver separator disk position information to the comparator.

The separator disk has a single blade and the servomotor rotates the separator disk in a single direction for separating signatures. In an alternate embodiment of the invention, the separator disk has two opposing blades and the servomotor is reversible to selectively rotate the separator disk in either of two directions.

The present invention employs a servo control system to gain several advantages over existing direct-drive type systems. One advantage is that the servomotor and separator disk can be readily inhibited by electronically deactivating the servomotor. Inhibiting the servomotor is desirable in situations where a single feeder in a multi-feeder system is required to skip feeding signatures for one or more system cycles. The servomotor may be inhibited manually or by pre-programming the feeder to inhibit the servomotor for a predetermined number of cycles at a particular time.

Another advantage is that servomotors are independently adjustable in position and speed. It is possible to adjust the relative position of a mis-aligned separator disk by shifting the position of the servomotor with respect to the stacked signatures while the feeder operates. This eliminates the necessity of turning the machine off and adjusting bearings, shafts and chains as may be required in known systems.

A further advantage of employing a servomotor is that servomotors do not require an overload clutch as may be required in known feeder drive systems. Additionally, where reversing the separator disk is desired, the servomotor of the present invention is readily reversible in response to an electrical signal without significant mechanical adjustment.

DETAILED DESCRIPTION OF THE INVENTION

Figure 1:
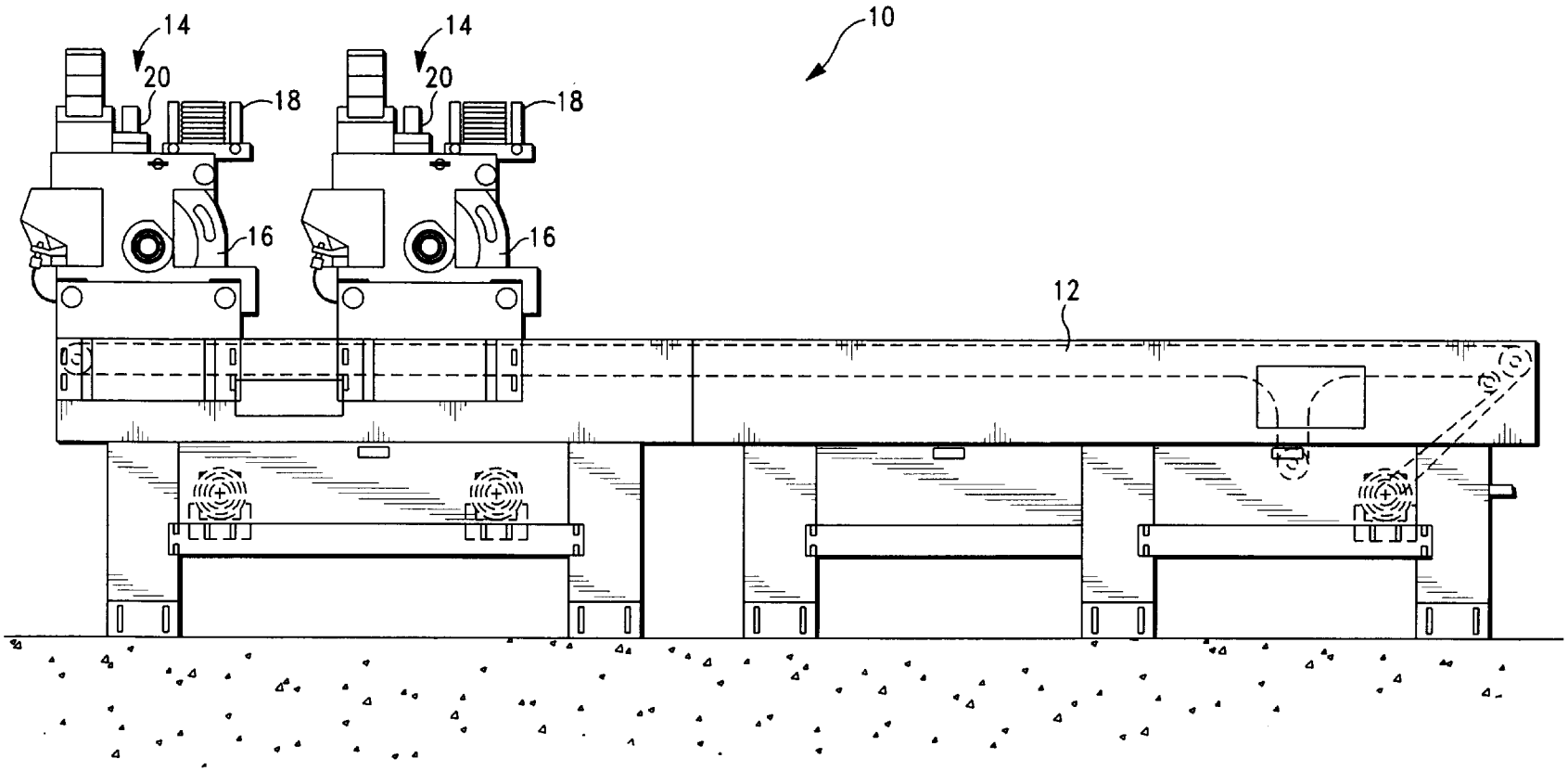
FIG. 1 is a side view of conveyer system including the present invention.

FIG. 1 shows a conveyer system generally designated with the reference numeral 10. The conveyer system 10 includes a conveyer 12, and a number of signature feeders 14. Each signature feeder 14 includes a rotatable feed drum 16, stacked signatures 18, and a separator disk servomotor 20. The feeder 14 separates signatures from the stacked signatures 18.

The conveyer 12 is positioned with respect to the feed drums 16 for receiving signatures from the feed drum. The feed drum 16 rotates and delivers signatures, one at a time, to the conveyer 12. The conveyer 12, in accordance with one aspect of the invention functions to gather signatures. The conveyer system 10 is configured having multiple feeders 14 to enable the conveyer 12 to gather and collate signatures for a binding machine, or other machine, for example.

Figure 2:
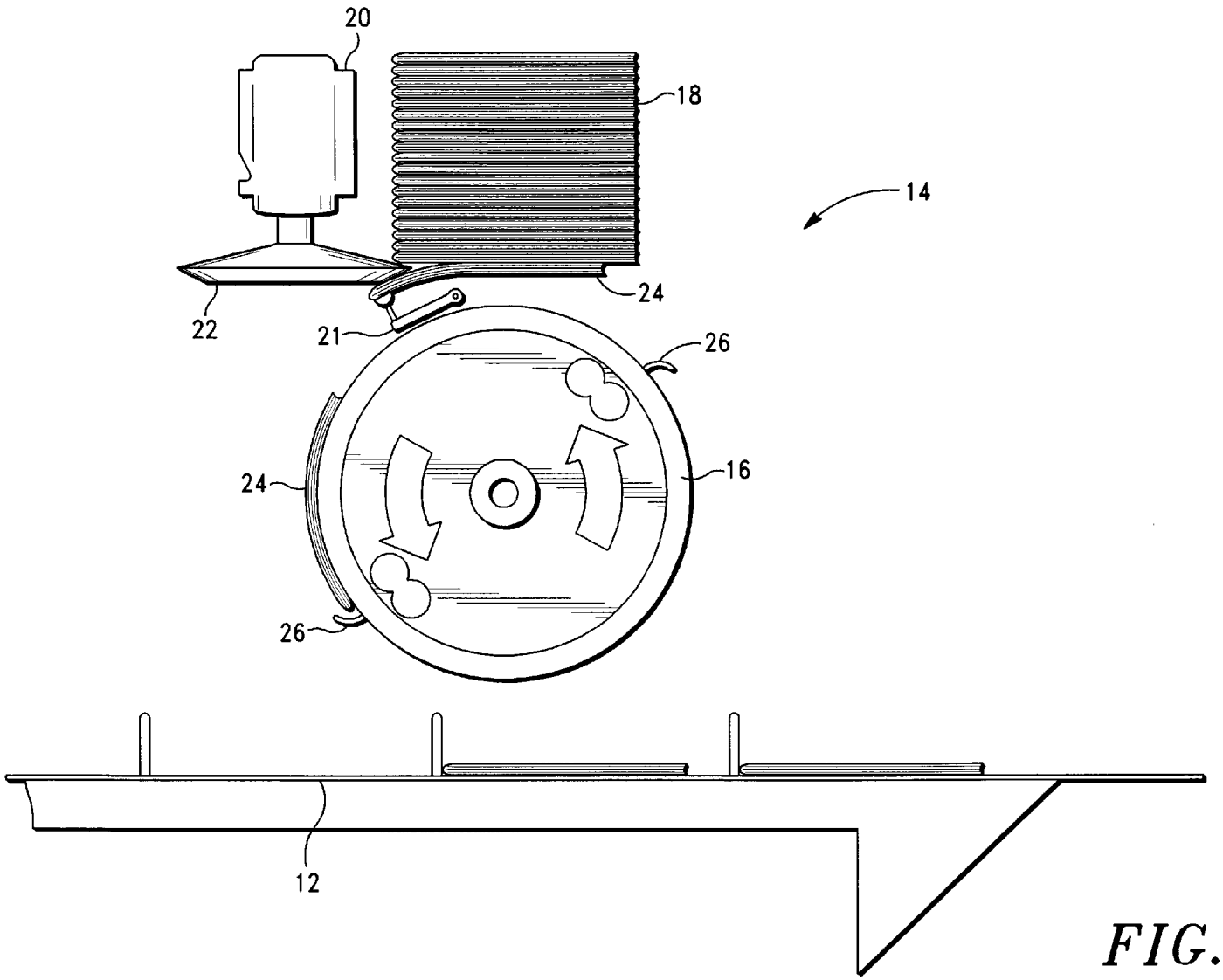
FIG. 2 is a side view of a signature feeder in accordance with the present invention.

FIG. 2 shows the signature feeder 14 having a sucker arm 21 and a separator disk 22. The separator disk 22 mechanically couples to the servomotor 20. The servomotor 20 rotates the separator disk 22 at a variable speed to separate signatures 24 from the stacked signatures and deliver the separated signatures to the conveyer 12.

When the separator disk 22 rotates to separate a signature 24 from the stacked signatures 18, the sucker arm 21 employs a vacuum to draw one end of the separated signature 24 from the separator disk 22 and position the end on the feed drum 16.

The feed drum 16 includes grippers 26. The feed drum 16 rotates the grippers 26 into a gripping position with respect to the separated signature 24 and then the gripper 26 grips the separated signature 24. Further rotation of the feed drum 16 delivers the separated signature 24 to the conveyer 12.

Figure 3:
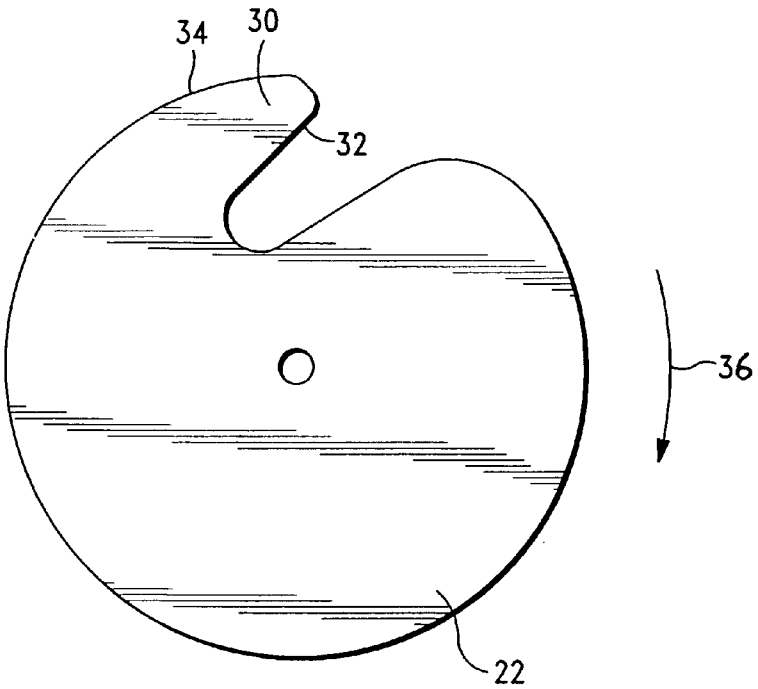
FIG. 3 is a top view of a separator disk in accordance with the present invention.

FIG. 3 shows a separator disk 22 having a single blade 30. The blade 30 has a leading edge 32 and a trailing edge 34. The separator disk 22 rotates in a single direction, in the direction of the arrow 36. During operation, the leading edge 32 of the blade 30 contacts the stacked signatures 18, further rotation of the separator disk 22 causes the blade to "bite" into the stacked signatures 18, separating a signature 24 from the stacked signatures 18. After separation of the signature 24 from the stacked signatures 18 is complete, the trailing edge 34 exits the stacked signatures 18.

Figure 4:
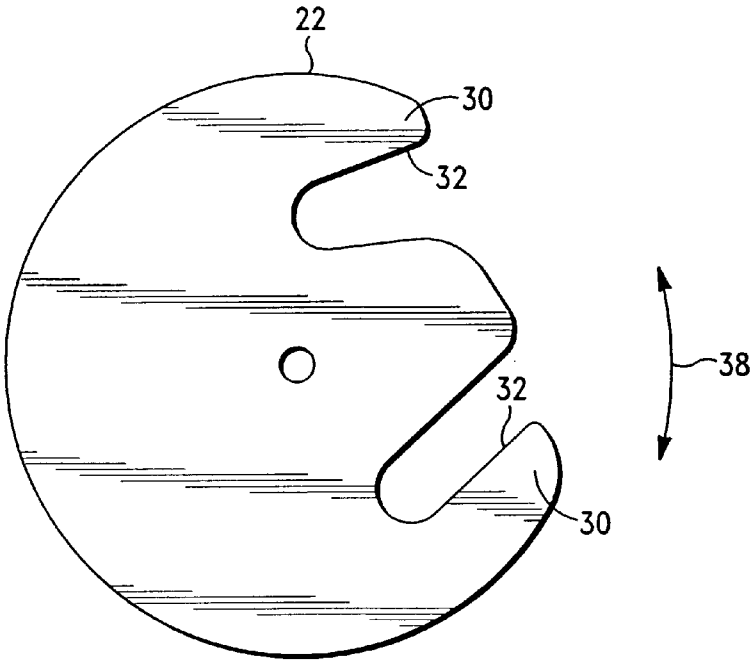
FIG. 4 is a top view of a separator disk in accordance with the present invention.

FIG. 4 shows a variation of the separator disk 22. The separator disk 22 has two opposing blades 30. The blades 30 oppose each other to enable the separator disk 22 to selectively rotate in either of the two directions shown by the arrows 38. Rotation in two directions is desirable depending on how signatures 18 are stacked. Optimally the leading edge 32 of the blade 30 rotates to contact a folded edge of the stacked signatures 18 to assure proper signature feeding. Opposing blades also enable the separator disk 22 to counter rotate, or reciprocate.

Figure 5:
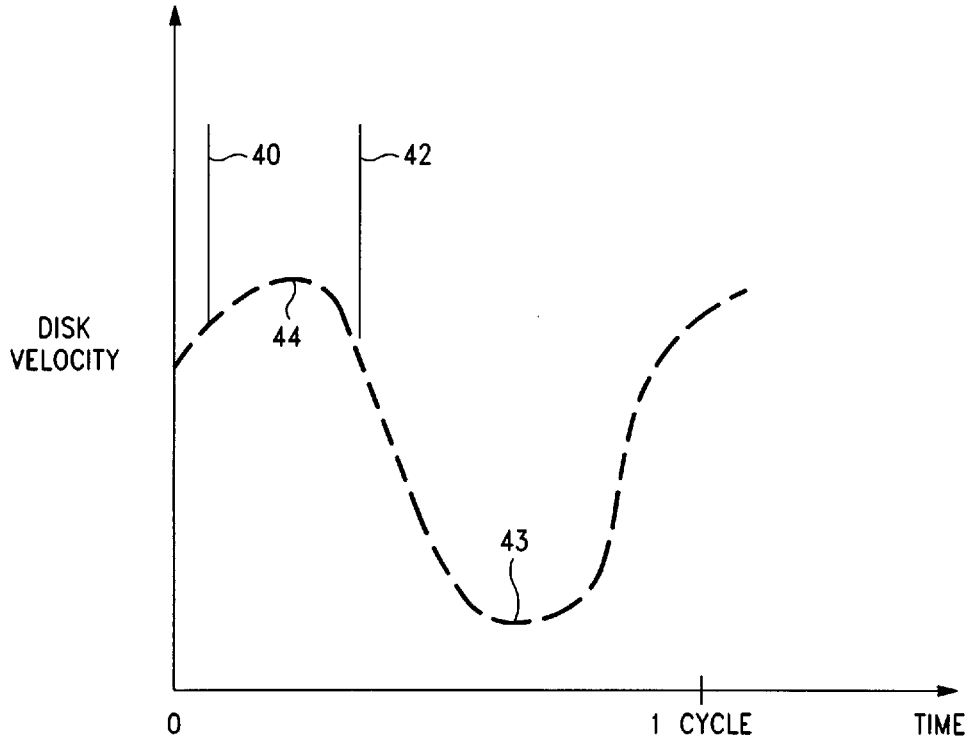
FIG. 5 is a graph of separator disk velocity v. time during a single separator disk cycle.

FIG. 5 shows a graph of the velocity of the separator disk 22. Each rotation of the separator disk 22 is a cycle. The cycle starts before the separator blade 30 leading edge 32 enters the stacked signatures 18 at position 40. The separator disk 22 accelerates after entry into the stacked signatures 18, reaching a maximum velocity at position 44. At position 44, the separator disk blade 30 continues to contact the stacked signatures 18. The separator disk 22 slows as the trailing edge 34 of the blade exits the stacked signatures 18 until the separator disk 22 reaches the position 43 where the velocity of the separator disk is at a minimum. A signature separates from the stacked signatures and the gripper grips the separated signature at some point between position 40 and position 42. After the signature separates, the disk 22 slows in preparation for another cycle.

In an alternative embodiment, the separator disk 22 slows after the trailing edge 34 exits the stacked signatures 18. It can be appreciated that the velocity profile can be modified in any number of ways to minimize the time required for signature separation.

Accelerating the blade 30 of the separator disk 22 through the stacked signatures 18 minimizes the amount of time required for signature separation. Minimizing the amount of time for signature separation allows the feed drum to rotate only slightly before a signature separates from the stacked signatures and the gripper grips the separated signature. This can result in space reduction between signatures gripped on the feed drum 16. Space reduction can be used to increase system throughput, reduce feed drum size, or alternatively, enable the feeder to feed larger signatures. The separator disk 22 slows after signature separation.

Figure 6:
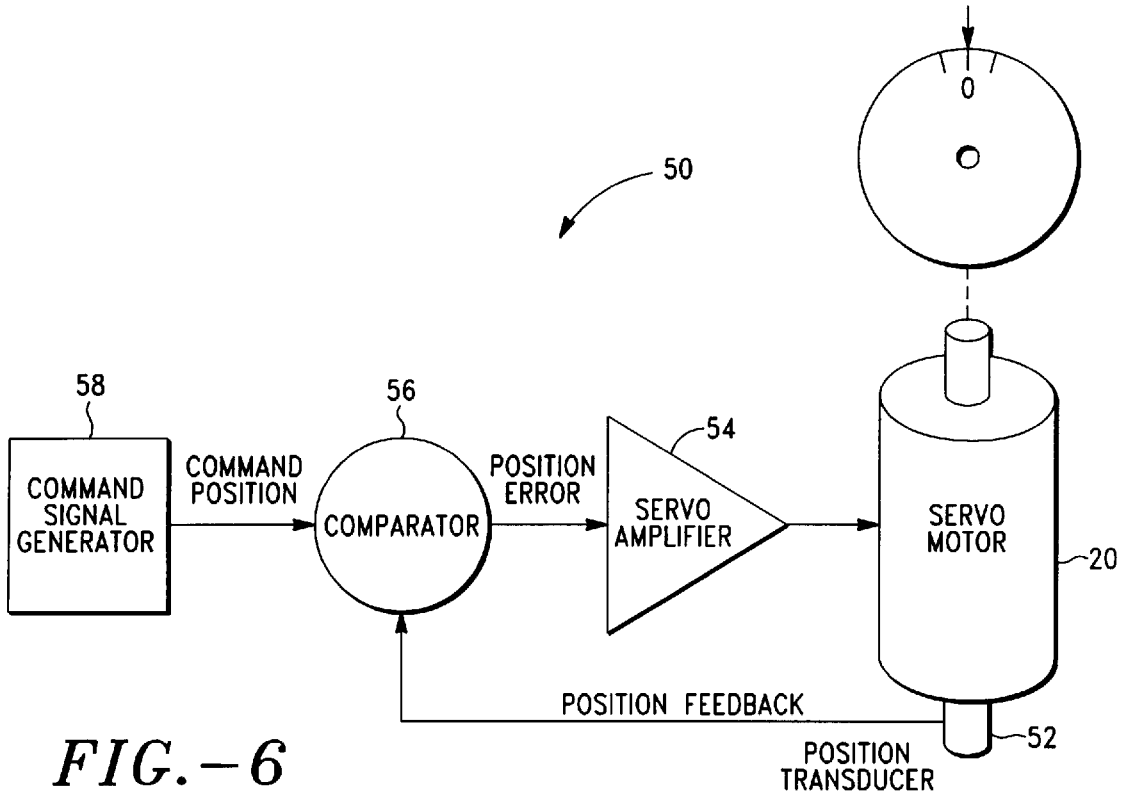
FIG. 6 is a plan view of a servo control system in accordance with the present invention.

FIG. 6 shows a servo control system generally designated with the reference numeral 50. The servo control system 50 includes the servomotor 20, a position transducer 52, a servo amplifier 54, a comparator 56, and a command signal generator 58.

The command signal generator 58 couples between the feed drum 16 and the comparator to detect feed drum 16 position and communicate the feed drum 16 position to the comparator 56. The comparator 56 couples with the servo control system 50 to coordinate the separator disk 22 rotation with respect to the feed drum 16 rotation. This coordination enables the gripper 26 (FIG. 2) to enter the gripping position when the separator disk 22 separates a signature 24 from the stacked signatures 18.

The servomotor 20 is a variable speed servomotor that mechanically couples with the separator disk 22 to rotate the separator disk 22 blade from a first position where the leading edge contacts the stacked signatures, to a second position where the blade separates a signature from the stacked signatures. According to one aspect of the invention, the servomotor includes an absolute encoder coupled with the comparator to deliver separator disk 22 position to the comparator 56. According to an alternate aspect of the invention, the servomotor 20 includes an incremental encoder, or a resolver.

The servo control system 50 includes a servo amplifier 54 coupled with the comparator 56. The comparator 56 detects servomotor 20 position error and communicates a signal reflective of the position error to the servo amplifier 54. The servo amplifier 54 amplifies the position error signal and communicates this amplified signal to the servomotor 20 to cause the servomotor 20 to automatically rotate the separator disk 22 to eliminate the position error.

The servo control system accelerates the separator disk 22 blade between the first position and the second position to separate a signature from the stacked signatures with optimal speed to increase feeder throughput and to assure feeder reliability. After the blade separates a signature from the stacked signatures, the servo control system slows the separator disk 22 to allow the feed drum 16 to deliver the separated signature to the conveyer.

One benefit of the servo control system 50 is that the system 50 can inhibit the servomotor 20 and selectively restart the servomotor 20. This can deliver a particular signature into one of every one hundred cycles, for example. Inhibiting the servomotor is desirable, for example, when the conveyer collates signatures for demographic distribution.

We claim:

1. A feeder for delivering stacked signatures to a conveyer, comprising:

a rotatable separator disk having a blade with a leading edge and a trailing edge;

a variable speed servomotor mechanically coupled to the separator disk to rotate the blade from a first position where the leading edge contacts the stacked signatures, to a second position where the separator disk separates a signature from the stacked signatures;

a servo control system coupled with the servomotor for regulating servomotor speed and accelerating the separator disk blade between the first position and the second position to quickly separate the signature from the stacked signatures; and a rotatable feed drum having at least one gripper, the feed drum rotates the gripper into a gripping position to grip the separated signature.

2. A feeder as set forth in claim 1, wherein the servo control system slows the separator disk after the separator disk separates the signature from the stacked signature.

3. A feeder as set forth in claim 1, wherein the feeder includes a command signal generator and a comparator, the command signal generator couples to the feed drum and to the comparator for detecting feed drum position and communicating feed drum position to the comparator; and the comparator couples with the servomotor to coordinate the separator disk rotation with the feed drum rotation so that the gripper enters the gripping position when the separator disk separates a signature from the stacked signatures.

4. A feeder as set forth in claim 3, wherein the servo control system includes a servo amplifier coupled with the comparator, the comparator calculates servomotor position error and communicates a signal reflective of the position error to the servo amplifier, the servo amplifier amplifies the position error signal and communicates the amplified signal to the servomotor to cause the servomotor to automatically rotate the separator disk to eliminate the position error.

5. A feeder as set forth in claim 4, wherein the servomotor includes an absolute encoder coupled with the comparator to deliver separator disk position information to the comparator.

6. A feeder as set forth in claim 1, wherein the separator disk has a single blade and the servomotor rotates the separator disk in a single direction for separating signatures.

7. A feeder as set forth in claim 1, wherein the separator disk has two opposing blades and the servomotor selectively rotate the separator disk in two directions.

8. A method for separating stacked signatures, comprising:

providing a servomotor and a separator disk having a blade for separating a signature from the stacked signatures; and rotating the separator disk with the servomotor at a variable velocity from a first position where the blade enters the stacked signatures to a second position where the blade separates a signature from the stacked signatures.

9. A method as set forth in claim 8, wherein rotating the separator disk includes accelerating the disk from the first position to the second position.

10. A method as set forth in claim 8, wherein rotating the separator disk includes slowing the disk after the signature separates from the stacked signatures.

11. A method as set forth in claim 8 further comprising gripping the separated signature.

12. A method as set forth in claim 11 further comprising delivering the separated signature to a conveyer.

13. A method as set forth in claim 8 further comprising using a servo drive system having an absolute encoder to regulate rotation of the separator disk.

14. A feeder for delivering stacked signatures to a conveyer, comprising:

a rotatable separator disk having a blade with a leading edge and a trailing edge;

a variable speed servomotor mechanically coupled with the separator disk to rotate the blade from a first position where the leading edge contacts the stacked signatures, to a second position where the separator disk separates a signature from the stacked signatures;

a servo control system coupled with the servomotor for regulating servomotor speed and accelerating the separator disk blade between the first position and the second position to quickly separate a signature from the stacked signatures;

a sucker arm coordinated with a feed drum for delivering the separated signatures to the feed drum;

the feed drum having and at least one gripper, the feed drum rotates the gripper into a gripping position with respect to the stacked signatures to grip separated signatures and deliver the separated signature to a conveyer; and a conveyer positioned with respect to the feed drum for receiving the separated signature from the feed drum.

15. A feeder as set forth in claim 14, wherein the separator disk reaches a maximum velocity between the first position and the second position.

16. A feeder as set forth in claim 14, wherein the separator disk has a single blade and the servomotor rotates the separator disk in a single direction for separating signatures.

17. A feeder as set forth in claim 14, wherein the separator disk has two opposing blades and the servomotor selectively rotates the separator disk in either of two directions.

18. A feeder as set forth in claim 14, wherein the feeder includes a command signal generator and a comparator, the command signal generator couples to the feed drum and to the comparator for detecting feed drum position and communicating feed drum position to the comparator; and the comparator couples with the servo motor to coordinate the separator disk rotation with the feed drum rotation so that the gripper enters the gripping position when the separator disk separates a signature from the stacked signatures.

19. A feeder as set forth in claim 18, wherein the servo control system includes a servo amplifier coupled with the comparator, the comparator calculates servomotor position error and communicates a signal reflective of the position error to the servo amplifier, the servo amplifier amplifies the position error signal and communicates the amplified signal to the servomotor to cause the servomotor to automatically rotate the separator disk to eliminate the position error.

20. A feeder as set forth in claim 14, wherein the servomotor is reversible.

* * * * *